United States Patent [19]

Hinata et al.

[11] 4,039,335

[45] Aug. 2, 1977

[54] PHOTOGRAPHIC SILVER HALIDE EMULSIONS

[75] Inventors: Masanao Hinata; Haruo Takei; Akira Sato; Atsuo Iwamoto; Jun Hayashi, all of Minami-ashigara, Japan

[73] Assignee: Fuji Photo Film Co., Ltd., Minami-ashigara, Japan

[21] Appl. No.: 737,130

[22] Filed: Oct. 29, 1976

[30] Foreign Application Priority Data

Oct. 29, 1975 Japan ..... 50-130014

[51] Int. Cl.[2] ..... G03C 1/14

[52] U.S. Cl. ..... 96/124; 96/137

[58] Field of Search ..... 96/124, 137

[56] References Cited

U.S. PATENT DOCUMENTS

| | | | |
|---|---|---|---|
| 3,922,170 | 11/1975 | Shiba et al. | 96/124 |
| 3,932,186 | 1/1976 | Borror | 96/124 |

*Primary Examiner*—J. Travis Brown

*Attorney, Agent, or Firm*—Sughrue, Rothwell, Mion, Zinn and Macpeak

[57] ABSTRACT

A silver halide photographic emulsion spectrally sensitized with a combination of sensitizing dyes consisting essentially of at least one sensitizing dye represented by the following general formula [I] and at least one sensitizing dye represented by the following general formula [II] in supersensitizing amounts:

General formula [I]

wherein $R^1$ and $R^2$ each is an alkyl group, $R^3$ is an alkyl group, $X_1$ is an acidic anion, $m$ is 1 or 2, and $m$ is 1 when the dye forms an intramolecular salt (betaine-like structure).

General formula [II]

wherein $Z^1$ is a sulfur atom or a selenium atom, $Z^2$ is an atomic group necessary to form a benzothiazole ring, a benzoselenazole ring, a naphtho[1,2-d]thiazole ring or a naphtho[1,2-d]selenazole ring, $R^4$ and $R^5$ is an alkyl group, $R^6$ is an alkyl group, a phenyl group, an aralkyl group, a furyl group or a thienyl group, $X_2$ is an acidic anion, $n$ is 1 or 2, and $n$ is 1 when the dye forms an intramolecular salt (betaine-like structure).

6 Claims, 4 Drawing Figures

PHOTOGRAPHIC SILVER HALIDE EMULSIONS

BACKGROUND OF THE INVENTION

1. Field of the Invention

The present invention relates to a photographic silver halide emulsion, more particularly, it relates to a silver halide photographic emulsion which is spectrally sensitized with two kinds of sensitizing dyes which have a supersensitizing effect in combination.

2. Description of the Prior Art

There are known various methods of spectrally sensitizing silver halide photographic emulsion, e.g., various methine dyes have been used for spectral sensitization. Among those, thiacarbocyanine dyes or selenacarbocyanine dyes are useful for spectrally sensitizing silver halide photographic emulsions in the red wave length region. On the other hand, a benzimidazolothiacarbocyanine dyes has its maximum spectral wave length at 590 nm to 620 nm and is therefore a useful sensitizing dye.

Where the above dyes are used alone, a sufficient supersensitizing effect cannot be obtained. A method where two kinds of sensitizing dyes are used is known as supersensitization and the super additive sensitizing effect produced therebetween brings about high spectral sensitivity. However, it is not easy to find dyes which provide a supersensitizing effect when used in combination. The slightest change in the chemical structure and a difference in substituents greatly influences the occurrence of a supersensiziting effect and a degree of the effect. Therefore, it is impossible to predict the occurrence of a sensitizing effect from chemical structure.

It is known that a combination of a thiacarbocyanine dye or a selenacarbocyanine dye and a dimethinemerocyanine dye is practically useful to panchromatically sensitize photographic light-sensitive materials in the graphic arts, particularly lithographic light-sensitive materials which yeild at a dot image from an original with continuous tone images using a contact screen (see U.S. Pat. No. 3,808,009 and German Patent Application (OLS) No. 2,101,071). This is because a merocyanine dye has advantageous properties such as an increased spectral sensitizing effect on an emulsion which is mainly composed of silver chloride and increased gradation (high contrast) in the preparation of the lith light-sensitive materials.

However, the above-mentioned spectral sensitizing method is insufficient for the purpose of decreasing residual color after development. Also, there are problems in the preparation of the light-sensitive materials, that is, where a solution of a merocyanine dye and a solution of a carbocyanine dye are mixed and stored, it often happens that fog is increased and sensitivity is lowered with the passage of time.

SUMMARY OF THE INVENTION

A first object of the present invention is to provide a silver halide photographic emulsion highly supersensitized in a red region.

A second object of the present invention is to provide a silver halide photographic emulsion having increased red sensitivity and suitable for preparing a lith light-sensitive material having less residual color after development.

A third object of the present invention is to provide a combination of sensitizing dyes undergoing less change with the passage of time in solution form.

We have found that there is an extremely useful supersensitizing effect between a benzimidazolothiacarbocyanine dye and a carbocyanine dye selected from a thiacarbocyanine and a selenacarbocyanine and having at least one of a naphtho [1,2-d]thiazole nucleus and a naphtho[1,2-d]selenazole nucleus.

It should be noted that a combination of a benzimidazolothiacarbocyanine and a 9-methylthiacarbocyanine dye which does not have a naphtho[1,2-d]thiazole nucleus hardly provides a supersensitizing effect.

The above objects of the present invention are attained by incorporating at least one sensitizing dye represented by the following general formula [I] and at least one sensitizing dye represented by the following general formula [II] in a silver halide photographic emulsion in the amount necessary to supersensitize the emulsion, in combination.

General formula [I]

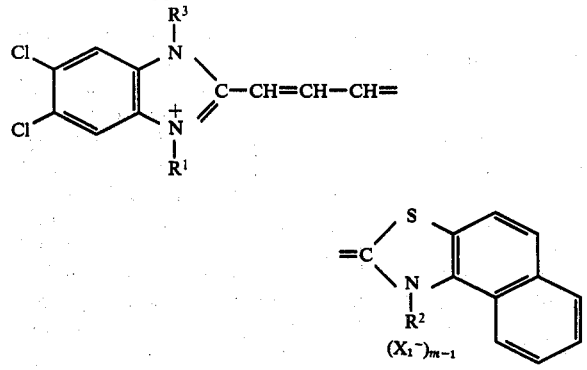

wherein $R^1$ and $R^2$ each is an alkyl group which may be substituted, $R^3$ is an alkyl group, $X_1$ is an acidic anion, $m$ is 1 or 2, and $m$ is 1 when the dye forms an intramolecular salt (betaine-like structure).

General formula [II]

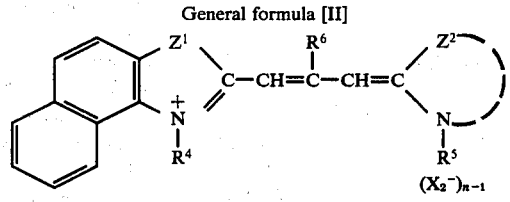

wherein $Z^1$ is a sulfur atom or a selenium atom, $Z^2$ is an atomic group necessary to form a benzothiazole ring, a benzoselenazole ring, a naphtho[1,2-d]thiazole ring or a naphtho[1,2-d]selenazole ring, $R^4$ and $R^5$ each is an alkyl group which may be substituted, $R^6$ is an alkyl group, a phenyl group, an aralkyl group, a furyl group or a thienyl group, $X_2$ is an acidic anion, $n$ is 1 or 2, and $n$ is 1 when the dye forms an intramolecular salt (bentaine-like structure).

BRIEF DESCRIPTION OF THE DRAWINGS

In FIG. 1, curves 1, 2 and 3 each shows the spectral sensitivity curves of Test Nos. 1–3, 1–5 and 1–7, respectively.

In FIG. 2, curves 4, 5 and 6 each shows the spectral sensitivity curves of Test Nos. 1–9, 1–11 and 1–13.

In FIG. 3, curves 7, 8 and 9 each shows the spectral sensitivity curves of Test Nos. 2–3, 2–15 and 2–17.

In FIG. 4, curves 10, 11 and 12 each shows the spectral sensitivity curves of Test Nos. 2–19, 2–21 and 2–23.

DETAILED DESCRIPTION OF THE INVENTION

Figure 1:
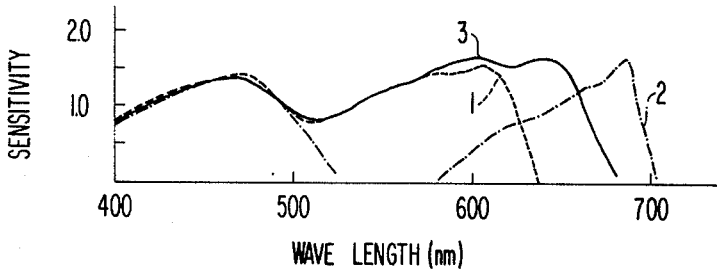
FIGS. 1–4 show the spectral sensitivity curves obtained in Example 1 or 2.
Figure 2:
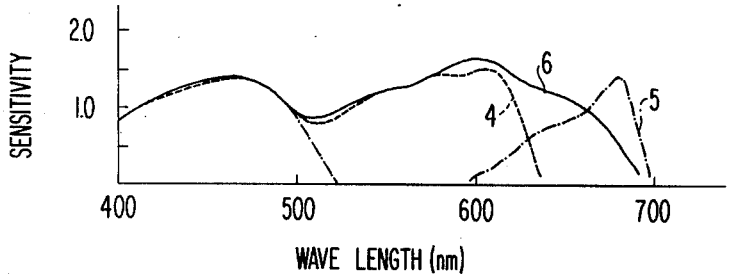
Figure 3:
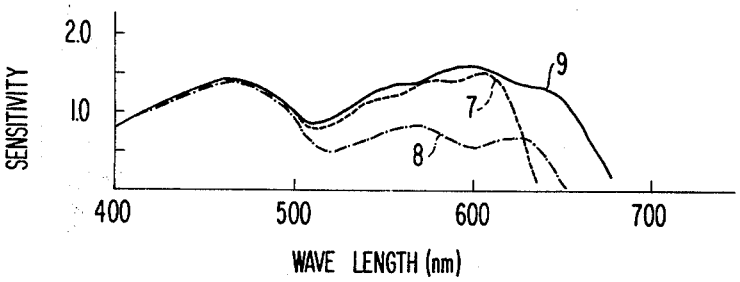
Figure 4:
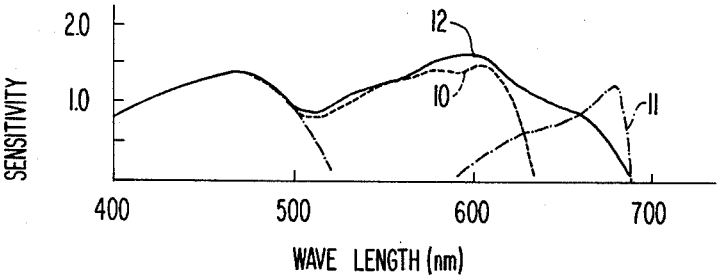

Each substituent in the above-mentioned general formulae [I] and [II] is preferably defined as follows.

$R^1$ and $R^2$ each is an alkyl group (preferably having 1 to 6 carbon atoms, e.g., a methyl group, an ethyl group, a propyl group or a butyl group) or a substituted alkyl group (where the alkyl moiety preferably has 1 to 8 carbon atoms, e.g., a sulfoalkyl group such as a 2-sulfoethyl group, a 3-sulfopropyl group, a 3-sulfobutyl group, 2-hydroxy-3-sulfopropyl group or a 4-sulfobutyl group; a carboxyalkyl group such as a carboxymethyl group, a 2-carboxyethyl group or a 3-carboxypropyl group; a hydroxyalkyl group such as a 2-hydroxyethyl group, a 3-hydroxypropyl group or a 4-hydroxybutyl group; a sulfoalkoxyalkyl group such as 2-(3-sulfopropoxy)-ethyl group, or a sulfoalkoxyalkoxyalkyl group such as a 3-sulfopropoxyethoxyethyl group, etc). $R^3$ is an alkyl group (preferably having 1 to 6 carbon atoms, e.g., a methyl group, an ethyl group, a propyl group or a vinylmethyl group, etc.). $R^4$ and $R^5$ are exemplified similarly to $R^1$ and $R^2$. $R^6$ is an alkyl group (e.g., a methyl group, an ethyl group or a propyl group), a phenyl group, an aralkyl group (e.g., phenethyl group), a furyl group or a thienyl group. $X_1$ and $X_2$ each is an acidic anion commonly used for cyanine dye salts such as iodide ion, a bromide ion, a chloride ion, a p-toluenesulfonic acid ion, a benzenesulfonic acid ion, a sulfuric acid ion, a perchloric acid ion or a thiocyanate ion (rhodan ion), etc.

Among those compounds represented by the above general formulae [I] and [II], the compounds represented by the following general formulae [I'] and [II'] are particularly useful in the present invention.

General formula [I']

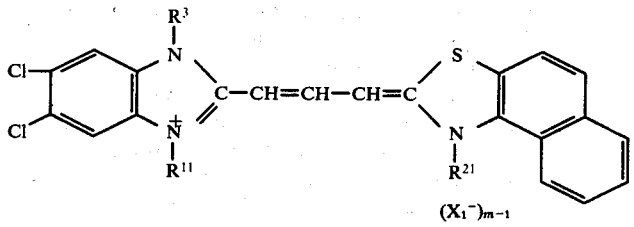

wherein $R^3$ is an alkyl group (preferably having 1 to 4 carbon atoms, e.g., a methyl group, an ethyl group or a propyl group, etc.) or an alkenyl group having 3 to 4 carbon atoms, $R^{11}$ and $R^{21}$ each is an alkyl group preferably having 1 to 6 carbon atoms which may be substituted and at least one of these a substituted alkyl group having a sulfo group, a carboxyalkyl group or a hydroxyalkyl group, $X_1$ is an acidic anion as earlier exemplified, $m$ is 1or 2, and $m$ is 1 when the dye forms an intramolecular salt (betaine-like structure).

General formula [II']

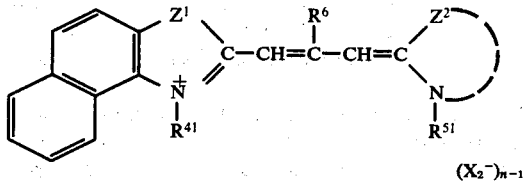

wherein $Z^1$ is a sulfur atom or a selenium atom, $Z^2$ is a benzothiazole ring, a benzoselenazole ring or a naphtho[1,2-d]thiazole ring, $R^6$ has the same meaning as in formula(II), $R^{41}$ and $R^{51}$ each is an alkyl group preferably having 1 to 6 carbon atoms which may be substituted and at least one of these is a substituted alkyl group having a sulfo group, a carboxyalkyl group or a hydroxyalkyl group, $X_2$ is an acidic anion as earlier exemplified, $n$ is 1 or 2, and $n$ is 1 when the dye forms an intramolecular salt (betaine-like structure).

Specific examples of the sensitizing dyes used in the present invention are shown below, but the present invention should not be limited thereto.

Specific examples of dyes represented by general formula [I].

(I-A)

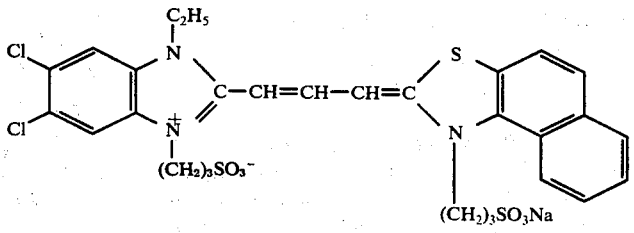

(I-B)
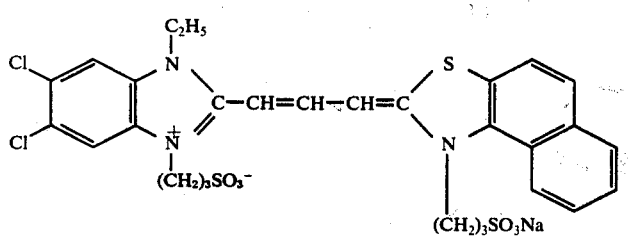
(I-C)
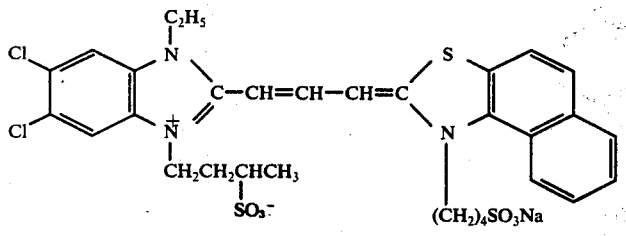
(I-D)
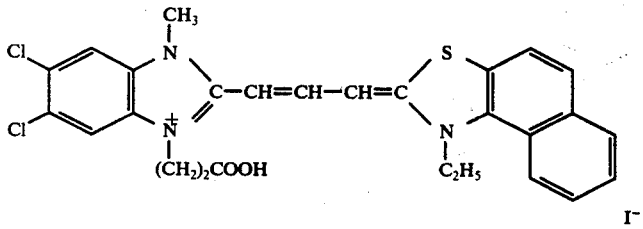
(I-E)
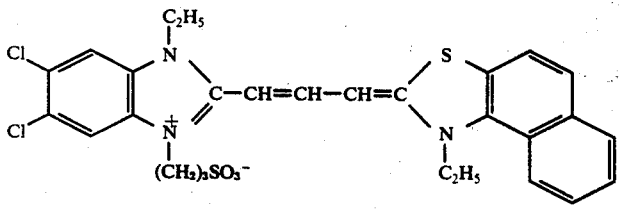
(I-F)
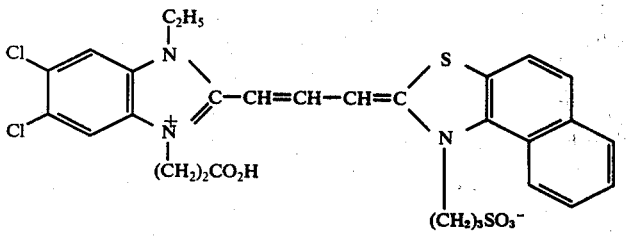
(I-G)
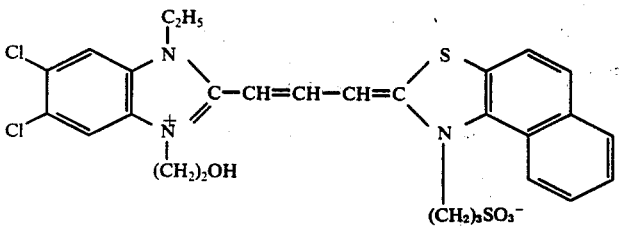
Specific examples of dyes represented by general formula [II]:

(II-A)
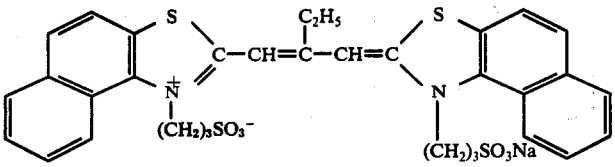
(II-B)
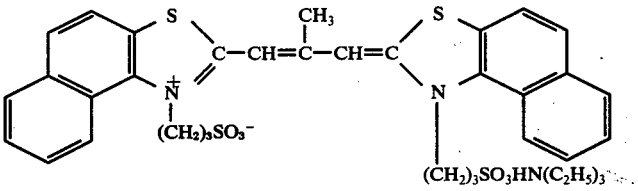
(II-C)
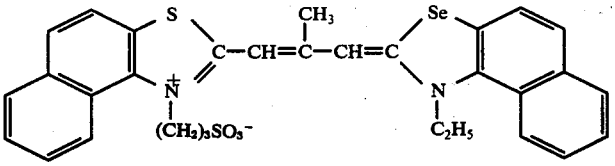
(II-D)
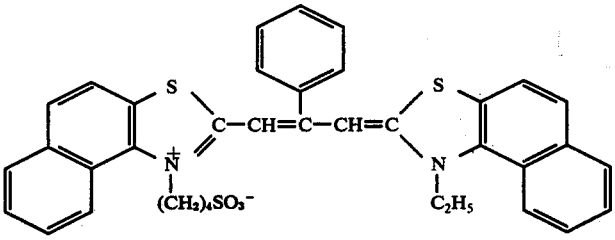
(II-E)
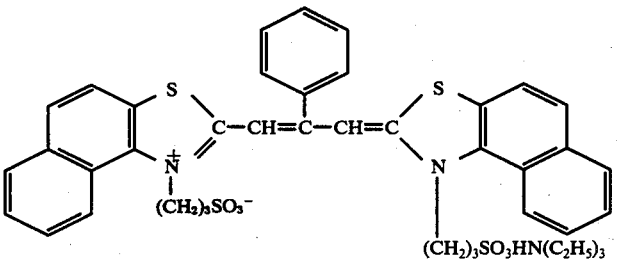
(II-F)
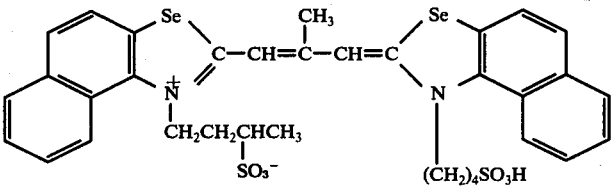
(II-G)
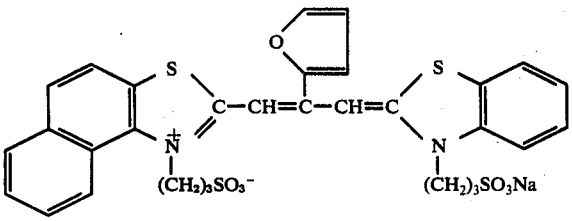
(II-H)

-continued
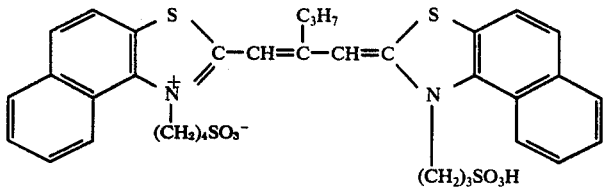
(II-I)
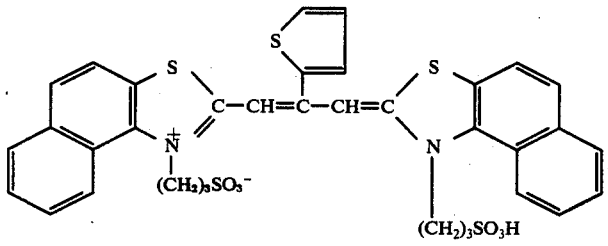
(II-J)
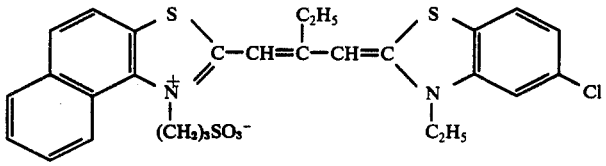
(II-K)
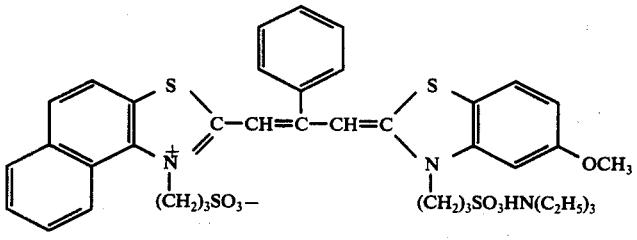
(II-L)
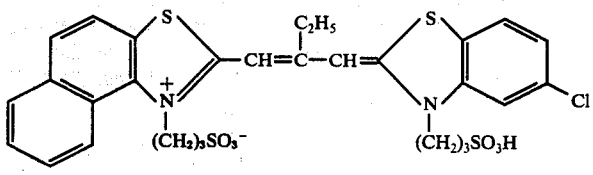
(II-M)
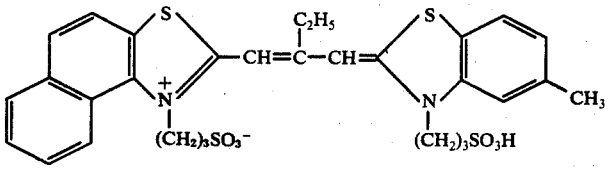
(II-N)
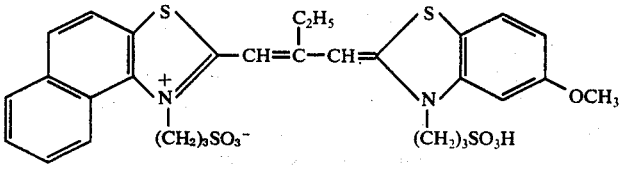
(II-O)

-continued

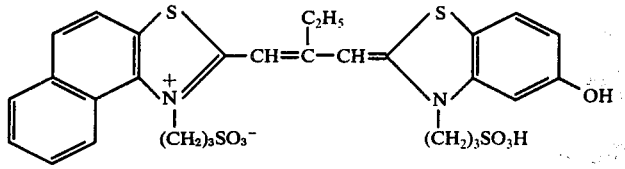

(II-P)

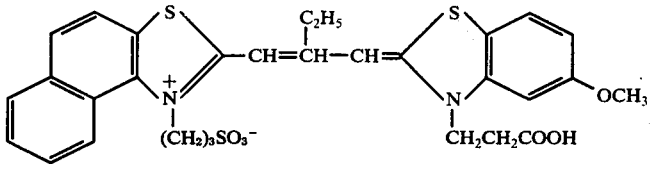

(II-Q)

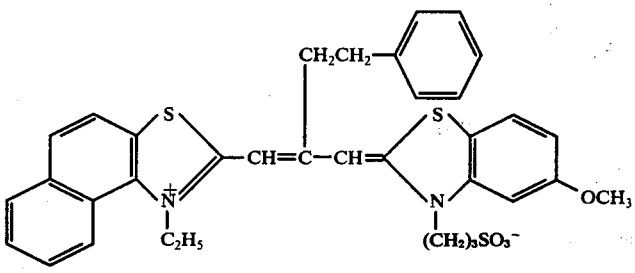

(II-R)

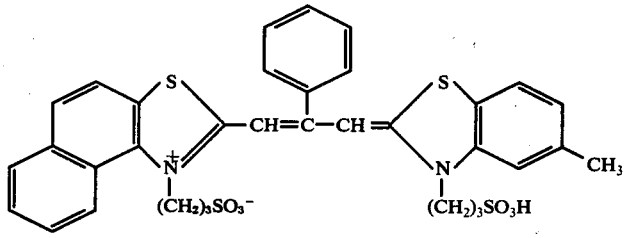

Compounds represented by general formula [I] or [II] are respectively incorporated in a silver halide emulsion in an amount of from about $5 \times 10^{-7}$ to about $5 \times 10^{-3}$ mol, preferably from $1 \times 10^{-6}$ to $2.5 \times 10^{-3}$ mol, and more preferably from $5 \times 10^{-6}$ to $1 \times 10^{-3}$ mol per 1 mol of silver halide (i.e., referring to the broad range both dyes of general formula [I] and [II] are coated in an amount of $5 \times 10^{-7}$ to $5 \times 10^{-3}$ mol/mol of silver halide per class of dyes). It is preferred that the ratio of the two dyes, that is, the dye(s) represented by the general formula [I] and the dye(s) represented by the general formula [II], be from 20/1 to ¼ (molar ratio). Where the amount of the dye represented by general formula [II] is increased, depending upon purpose, red sensitivity is increased and the maximum spectral wave length can be shifted to a longer wave length.

The silver halide photographic emulsion of the present invention is prepared in a conventional manner, which can include silver chloride, silver bromide, silver iodide or mixed silver halide grains thereof which are precipitated by a single jet method, a double jet method or a combined method thereof. The desirable silver halide is silver iodobromide, silver chlorobromide or silver chloroiodobromide (the preferred iodide content is not more than 10 mol%). The silver halide can be large grain or fine grain. The average grain diameter (e.g., measured by numerical average method based on the projected area of grains) is preferably from 0.04 to 4 μ.

To the silver halide photographic emulsion of the present invention, there can be applied a conventional chemical sensitizing method such as a gold sensitizing method (see U.S. Pat. Nos. 2,399,083, 2,540,085, 2,597,856 and 2,597,915), a sensitizing method using a metallic ion belonging to group VIII of the Periodic table (see U.S. Pat. Nos. 2,448,060 and 2,598,079), a sulfur sensitizing method (see U.S. Pat. Nos. 1,574,944 and 2,410,689), a reduction sensitizing method (see U.S. Pat. Nos. 2,518,698, 2,419,974 and 2,983,610) and a combined method thereof.

The sensitizing dye used in the present invention can be added to the silver halide emulsion in the form of an aqueous solution or a water-miscible organic solvent solution such as a methanol, ethanol, methylcellosolve, dimethylformamide or pyridine solution. The sensitizing dye can be dissolved by ultrasonic vibrations as disclosed in U.S. Pat. No. 3,485,634, if desired. Other methods of dissolving or dispersing the sensitizing dyes and then incorporating them into an emulsion can also be employed as disclosed in U.S. Pat. Nos. 3,482,981, 3,585,195, 3,469,987, 3,425,835, 3,342,605, British Pat. Nos. 1,271,329, 1,038,029, 1,121,174 and U.S. Pat. Nos. 3,660,101 and 3,658,546. The methods disclosed in German Patent Application No. (OLS), 2,104,283 and U.S. Pat. No. 3,649,286 can also be employed.

Color couplers and dispersing agents therefor can be incorporated in the silver halide photographic emulsion of the present invention, if desired.

Among the color couplers, particularly cyan couplers can be added. For instance, the phenolic couplers as disclosed in U.S. Pat. No. 2,698,794 and the naphtholic couplers as disclosed in U.S. Pat. No. 2,474,293 are particularly useful.

Those couplers as disclosed in U.S. Pat. No. 2,600,788, British Pat. No. 904,852 and Japanese Patent Publication No. 6031/65 or α-naphtholic cyan couplers and phenolic cyan couplers (U.S. Pat. Nos. 3,311,476, 3,458,315, 3,215,437 and 3,253,294) can be employed.

Typical colored couplers which can be used are those disclosed in U.S. Pat. Nos. 3,034,892, 3,386,301 and 2,434,272.

Typical DIR couplers which can be used are those as disclosed in U.S. Pat. Nos. 3,148,062, 3,227,554, 3,701,783, 3,617,291, 3,622,328, Japanese Patent Publication No. 28836/70, Japanese Patent Application No. 33238/73 and German Patent Application No. (OLS) 2,163,811.

The thus prepared emulsion can be coated on a suitable support such as a baryta paper, a resin coated paper, a synthetic paper, a triacetate film, a polyethylene terephthalate film or a glass plate. One skilled in the art will easily be enabled to make all dyes used in this invention. See, e.g., for dye (I) British Pat. No. 1,138,395 and for dye (II) U.S. Pat. NO. 3,177,210.

Specific examples of the present invention are given below, but the present invention should not be limited thereto.

EXAMPLE 1

Silver halide grains were prepared by a single jet method, physically ripened, desalted and chemically ripened in a conventional manner to obtain a silver iodobromide emulsion (iodide content; 8.0 mol%). The average diameter of the silver halide grains contained in the emulsion was 0.7 micron. 0.5 mol of silver halide was present per 1 Kg of the emulsion, 55 g of gelatin was present per 1 Kg of the emulsion. 1 Kg of the emulsion was introduced into a container and then dissolved on a constant temperature bath at 50° C. A methanol solution of the sensitizing dyes of the present invention was added in an amount as shown in Table 1 and mixed with stirring at 40° C. 10 ml of a 1 wt% aqueous solution of 4-hydroxy-6-methyl-1,3,3a,7-tetrazaindene and 10 ml of a 1 wt% aqueous solution of sodium 1-hydroxy-3,5-dichlorotriazine were then added thereto, whereafter 10 ml of a 1 wt% aqueous solution of sodium dodecylbenzenesulfonate was subsequently added with stirring. Thus prepared emulsion was coated on a cellulose triacetate film base in the dry thickness of 5 microns, followed by drying, to obtain a sample of the light-sensitive material.

The film sample was cut into strips. One of these was exposed through an optical wedge to a sensitometer having a light source with a color temperature of 5400° K equipped with a red filter (SC-56 prepared by Fuji Photo Film Co., Ltd.) and a blue filter (Wratten 47B prepared by Eastman Kodak Co., Ltd.), respectively. On the other hand, another exposure was carried out on another sample to obtain spectrogram by a diffraction lattice type spectrograph. Development with a solution having the following composition for 2 min. at 20° C, stopping, fixing and washing with water were carried out to obtain strips with black-and-white images. The densities were measured by p-type densitometer prepared by Fuji Photo Film Co., Ltd. to obtain red sensitivity (SR), blue sensitivity (SB) and fog. The standard point of the optical density to determine sensitivity was [fog + 0.20].

| Compositions of the developing solution: | | |
|---|---|---|
| Water | 500 | ml |
| Methol | 2.2 | g |
| Anhydrous sodium sulfite | 96.0 | g |
| Hydroquinone | 8.8 | g |
| Sodium carbonate (monohydrate) | 56.0 | g |
| Potassium bromide | 5.0 | g |
| Water to make | 1 | liter |

The results are shown as relative values in Table 1.

Table 1

| Test No. | Sensitizing dyes and amount thereof* (× $10^{-5}$ mol) | | | | SR | SB | Fog |
|---|---|---|---|---|---|---|---|
| 1- 1 | | — | | — | — | 100 | 0.05 |
| 2 | (I-A) | 3 | | — | 100 | 98 | 0.05 |
| 3 | | 6 | | — | 178 | 93 | 0.05 |
| 4 | | — | (II-A) | 0.4 | 35 | 96 | 0.05 |
| 5 | | — | | 0.8 | 78 | 96 | 0.05 |
| 6 | (I-A) | 3 | (II-A) | 0.4 | 214 | 96 | 0.05 |
| 7 | | 3 | | 0.8 | 250 | 96 | 0.05 |
| 1- 8 | (I-C) | 3 | | — | 104 | 98 | 0.05 |
| 9 | | 6 | | — | 170 | 96 | 0.05 |
| 10 | | — | (II-B) | 0.4 | 17 | 96 | 0.05 |
| 11 | | — | | 0.8 | 36 | 96 | 0.05 |
| 12 | (I-C) | 6 | (II-B) | 0.4 | 230 | 96 | 0.05 |
| 13 | | 6 | | 0.8 | 264 | 94 | 0.05 |
| 1- 14 | (I-F) | 3 | | — | 100 | 100 | 0.05 |
| 15 | | 6 | | — | 170 | 96 | 0.05 |
| 16 | | — | (II-D) | 0.4 | 16 | 100 | 0.05 |
| 17 | | — | | 0.8 | 31 | 100 | 0.05 |
| 18 | (I-F) | 6 | (II-D) | 0.4 | 210 | 96 | 0.05 |
| 19 | | 6 | | 0.8 | 220 | 96 | 0.05 |
| 1- 20 | (I-B) | 3 | | — | 96 | 98 | 0.05 |
| 21 | | 6 | | — | 166 | 96 | 0.05 |
| 22 | | — | (II-K) | 0.4 | 14 | 100 | 0.05 |
| 23 | | — | | 0.8 | 34 | 96 | 0.05 |
| 24 | (I-B) | 6 | (II-K) | 0.4 | 204 | 96 | 0.05 |
| 25 | | 6 | | 0.8 | 230 | 96 | 0.05 |
| 1- 26 | (I-B) | 6 | (A) for | 0.4 | 166 | 96 | 0.05 |
| 27 | | 6 | Compari- | 0.8 | 178 | 96 | 0.05 |
| 28 | | 6 | son | 2 | 178 | 90 | 0.05 |

* All as earlier identified; hereafter the same.

Sensitivity SR is the relative value where the value obtained in Test No. 1–2 is 100.

It is clear from Table 1 that the combined use of the sensitizing dyes of the present invention is superior. That is, for example, the combined use of dye (I-B) with dye (II-K) provides a red sensitivity from about 20% to 38% higher. On the other hand, the combined use of dye (I-B) with dye (A) for comparison provides a red sensitivity only 7% higher. Further, it is clear that maximum red sensitivity obtained by the combined use of the sensitizing dyes of the present invention provides about a 20% higher red sensitivity than that of the combined use of dye (A) for comparison.

EXAMPLE 2

A silver iodobromide emulsion (iodide content, 8.5 mol%) was obtained in the same manner as in Example 1. The average diameter of the silver halide grains contained in the emulsion was 1.3 microns. 0.74 mol of silver halide was present per 1 Kg of the emulsion.

80 g of 1-hydroxy-N{γ-(2,4-di-tert-amylphenoxypropyl)}-2-naphthoamide was completely dissolved in a mixture of 100 ml of tricresyl phosphate and 50 ml of ethyl acetate. 2 g of sorbitan monolaurate was then added and dissolved therein. This solution was added to 1 Kg of a 10 wt% aqueous gelatin solution to which 2.5 g of dodecylbenzenesulfonic acid was added in the form of an aqueous solution, stirred at high speed and dispersed with ultrasonic waves to obtain a dispersion.

1 Kg of the above-mentioned silver iodobromide emulsion was introduced into a container and dissolved on a constant temperature bath at 50° C. Methanol solutions of the sensitizing dyes for comparison were added respectively at a predetermined amount, as set out in Table 2, mixed with stirring at 40° C and allowed to stand for 15 minutes, whereafter, there were then added thereto, in sequence, 300 g of above-mentioned dispersion, 10 ml of 1 wt% aqueous solution of 4-hydroxy-6-methyl-1,3,3a,7-tetrazaindene, 10 ml of 1 wt% aqueous solution of sodium 1-hydroxy-3,5-dichlorotriazine and 10 ml of 1 wt% aqueous solution of sodium dodecylbenzenesulfonate, followed by stirring.

The thus prepared emulsion was coated on a cellulose triacetate film base in a dry thickness of 5 microns, and than a protective layer mainly composed of gelatin was coated thereon to a dry thickness of 1 micron and dried to obtain a sample of light-sensitive material. A part of a film sample was exposed through an optical wedge to a sensitometer having a light source with a color temperature of 5400° K equipped with a red filter (Fuji SC-56 filter). The exposure conditions were such that the illuminance was 256 lux and the exposure time was 1/20 sec. Another part of each film sample was exposed to a grating type spectrograph to obtain a spectrogram.

This sample was developed at 38° C by the color-negative developing processing shown below.

| | | | | | |
|---|---|---|---|---|---|
| 1. | Color development | 3 | min. | 15 | sec. |
| 2. | Bleaching | 6 | " | 30 | " |
| 3. | Water-washing | 3 | " | 15 | " |
| 4. | Fixing | 6 | " | 30 | " |
| 5. | Water-washing | 3 | " | 15 | " |
| 6. | Stabilizing | 3 | " | 15 | " |

The compositions of the processing solutions employed in each step were as follows:

| | | |
|---|---|---|
| **Color developing solution:** | | |
| Sodium nitrilotriacetate | 1.0 | g |
| Sodium sulfite | 4.0 | g |
| Sodium carbonate | 30.0 | g |
| Potassium bromide | 1.4 | g |
| Hydroxylaminosulfate | 2.4 | g |
| 4-(N-ethyl-N-β-hydroxyethyl-amino)-2-methylanilino sulfate | 4.5 | g |
| Water to make | 1 | liter |
| **Bleaching solution:** | | |
| Ammonium bromide | 160.0 | g |
| Ammonia water (28%) | 25.0 | ml |
| Iron (III)-sodium ethylenediaminetetracetate complex salt | 130.0 | g |
| Glacial acetic acid | 14.0 | g |
| Water to make | 1 | liter |
| **Fixing solution:** | | |
| Sodium tetrapolyphosphate | 2.0 | g |
| Sodium sulfite | 4.0 | g |
| Ammonium thiosulfate (70 wt%) | 175.0 | ml |
| Sodium bisulfite | 4.6 | g |
| Water to make | 1 | liter |
| **Stabilizing solution:** | | |
| Formalin (40 wt%) | 8.0 | ml |
| Water to make | 1 | liter |

Thus prepared strips were measured by a P-type densitometer manufactured by Fuji Photo Film Co., Ltd. to obtain relative sensitivities and cyan color fog. The standard point of the optical density to determine sensitivity was [fog + 0.20]. The results are shown as relative values in Table 2.

Table 2

| Test No. | Sensitizing dyes and amount thereof (× $10^{-5}$ mol) | | | | SR | Fog |
|---|---|---|---|---|---|---|
| 2- 1 | | — | | — | — | 0.07 |
| 2 | (I-F) | 4 | | — | 100 | 0.07 |
| 3 | | 8 | | — | 168 | 0.07 |
| 4 | | — | (II-A) | 0.5 | 81 | 0.07 |
| 5 | | — | | 1 | 75 | 0.07 |
| 6 | (I-F) | 8 | (II-A) | 0.5 | 216 | 0.07 |
| 7 | | 8 | | 1 | 255 | 0.07 |
| 2- 8 | (I-B) | 4 | | — | 92 | 0.07 |
| 9 | | 8 | | — | 170 | 0.07 |
| 10 | | — | (II-E) | 0.5 | 20 | 0.07 |
| 11 | | — | | 1 | 38 | 0.07 |
| 12 | (I-B) | 8 | (II-E) | 0.5 | 210 | 0.07 |
| 13 | | 8 | | 1 | 228 | 0.07 |
| 2- 14 | | — | (II-B) | 0.5 | 14 | 0.07 |
| 15 | | — | | 1 | 33 | 0.07 |
| 16 | (I-F) | 8 | (II-B) | 0.5 | 233 | 0.07 |
| 17 | | 8 | | 1 | 260 | 0.07 |
| 2- 18 | (I-C) | 4 | | — | 106 | 0.07 |
| 19 | | 8 | | — | 168 | 0.07 |
| 20 | | — | (II-K) | 0.5 | 11 | 0.07 |
| 21 | | — | | 1 | 30 | 0.07 |
| 22 | (I-C) | 8 | (II-K) | 0.5 | 220 | 0.07 |
| 23 | | 8 | | 1 | 233 | 0.07 |
| 2- 24 | | — | (II-J) | 0.5 | 28 | 0.07 |
| 25 | | — | | 1 | 52 | 0.07 |
| 26 | (I-C) | 8 | (II-J) | 0.5 | 216 | 0.07 |
| 27 | | 8 | | 1 | 228 | 0.07 |
| 2- 28 | (I-C) | 8 | (B) for | 0.5 | 172 | 0.07 |
| 29 | | 8 | Comparison | 1 | 176 | 0.07 |

The sensitivity SR is comparative sensitivity where the value obtained in Test No. 2—2 is set as 100.

It is clear from Table 2 that the combined use of the dyes of the present invention is superior. That is, for example, the combined use of dye (I-F) with dye (II-A) provides a red sensitivity from 1.5 times to 2 times higher (Test No. 2—2 to No. 2-7). Where the amount of the dye as represented by general formula [II] is increased, depending upon purpose, red sensitivity is increased and the maximum spectral wave length can be shifted to a longer wave length. This is clear from the spectral sensitivity curves in FIG. 1.

Test Nos. 2-28 and 2-29, where dye (B) for comparison was used in combination, show remarkably low sensitivity as compared with that of the present invention. The spectral sensitivity curves thereof are nearly the same as those of dye (I-C). Sensitivity was hardly increased where the amount of the dye (B) was increased.

The chemical formulae of the dyes used for comparison in the Example was as follows:

(A)

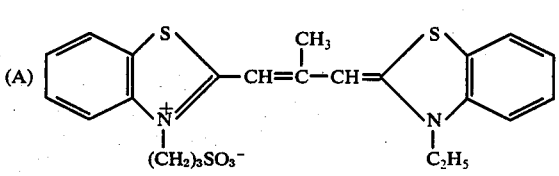

(B)

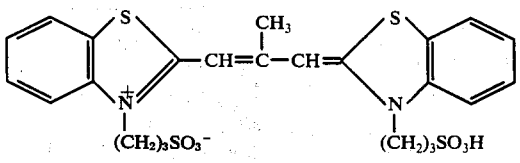

While the invention has been described in detail and with reference to specific embodiments thereof, it will be apparent to one skilled in the art that various changes and modifications can be made therein without departing from the spirit and scope thereof.

What is claimed is:

1. A silver halide photograhic emulsion spectrally sensitized with a combination of sensitizing dyes consisting essentially of at least one sensitizing dye represented by the following general formula [I] and at least one sensitizing dye represented by the following general formula [II] in supersensitizing amounts:

General formula [I]

[I]

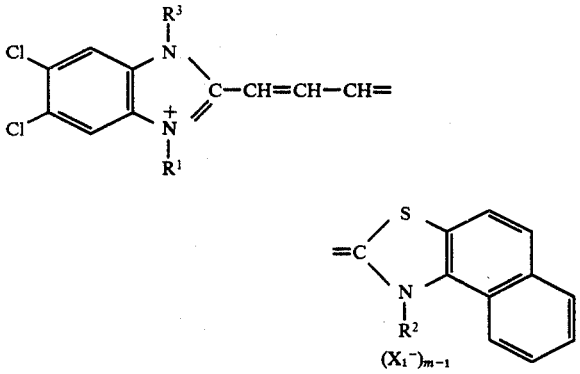

wherein $R^1$ and $R^2$ each is an alkyl group, $R^3$ is an alkyl group, $X_1$ is an acidic anion, $m$ is 1 or 2, and m is 1 when the dye forms an intramolecular salt (betaine-like structure).

General formula [II]

[II]

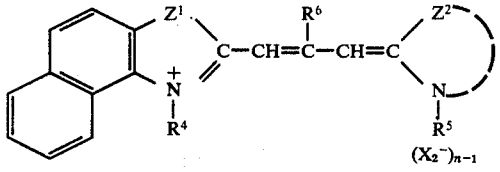

wherein $Z^1$ is a sulfur atom or a selenium atom, $Z^2$ is an atomic group necessary to form a benzothiazole ring, a benzoselenazole ring, a naphtho[1,2-d]thiazole ring or a naphtho[1,2-d]selenazole ring, $R^4$ and $R^5$ each is an alkyl group, $R^6$ is an alkyl group, a phenyl group, aralkyl group, a furyl group or a thienyl group, $X_2$ is an acidic anion, $n$ is 1 or 2, and $n$ is 1 when the dye forms an intramolecular salt (betaine-like structure).

2. The supersensitized silver halide photograhic emulsion of claim 1 wherein the dye represented by the general formula [I] is represented by the general formula [I'] and the dye represented by the general formula [II] is represented by the general formula [II']:

General formula [I']

[I']

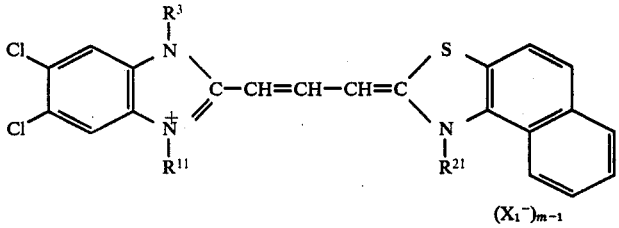

wherein $R^3$ is an alkyl group, $R^{11}$ and $R^{21}$ each is an alkyl group and at least one of these is a substituted alkyl group having a sulfo group, a carboxyalkyl group or a hydroxyalkyl group, $X_1$ is an acidic anion, $m$ is 1 or 2, and $m$ is 1 when the dye forms an intramolecular salt (betaine-like structure).

General formula [II']

[II']

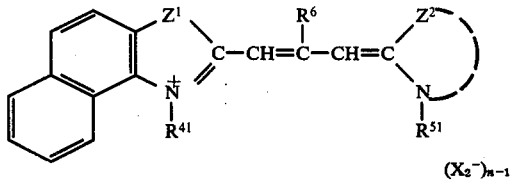

wherein $Z^1$ is a sulfur atom or a selenium atom, $Z^2$ is a benzothiazole ring, a benzoselenazole ring or a naphtho[1,2-d]thiazole ring, $R^6$ has the same meaning as in formula (II), $R^{41}$ and $R^{51}$ each is an alkyl group and at least one of these is a substituted alkyl group having a sulfo group, a carboxyalkyl group or a hydroxyalkyl group, $X_2$ is an acidic anion, $n$ is 1 or 2, and $n$ is 1 when the dye forms an intramolecular salt (betainelike structure).

3. The supersensitized silver halide photographic emulsion of claim 2 wherein $Z^1$ in general formula [II'] is a sulfur atom, the ring completed by $Z^2$ is a naphtho[1,2-d]-thiazole ring and $R^6$ is a methyl group or an ethyl group.

4. The supersensitized silver halide photographic emulsion of claim 2 wherein the ring completed by $Z^2$ in general formula [II'] is a naphtho[1,2-d]thiazole ring, a benzothiazole ring substituted at the 5-position with a methyl group, an ethyl group, a hydroxy group, a methoxy group or an ethoxy group, a benzothiazole ring or a benzoselenazole ring and $R^6$ is a phenyl group.

5. The supersensitized silver halide photographic emulsion of claim 2 wherein $Z^1$ in general formula [II'] is a sulfur atom, a naphtho[1,2-d]thiazole ring is completed by $Z^2$ and $R^6$ is a phenyl group.

6. The supersensitized silver halide photographic emulsion of claim 2 wherein the molar ratio of the sensitizing dye(s) represented by general formula [I'] to the sensitizing dye(s) represented by general formula [II'] is from 10/1 to 1/1.

* * * * *